United States Patent [19]

Fregeolle

[11] 4,041,736

[45] Aug. 16, 1977

[54] LOWER BODY GARMENT AND METHOD OF MAKING SAME

[75] Inventor: Oscar Fregeolle, Hickory, N.C.

[73] Assignee: Pilot Research Corporation, Valdese, N.C.

[21] Appl. No.: 406,813

[22] Filed: Oct. 16, 1973

[51] Int. Cl.[2] ..... A41B 9/00; A41B 11/00

[52] U.S. Cl. ..... 66/177

[58] Field of Search ..... 66/176, 177, 187, 186; 2/224 R, 409

[56] References Cited

U.S. PATENT DOCUMENTS

| | | | |
|---|---|---|---|
| 358,383 | 2/1887 | Clow | 66/187 |
| 490,241 | 1/1893 | Black, Jr. | 66/187 |
| 1,117,934 | 11/1914 | West | 66/187 |
| 1,789,494 | 1/1931 | Page | 66/187 X |
| 2,950,611 | 8/1960 | Getaz | 66/186 |
| 3,670,529 | 6/1972 | Eregeolle | 66/177 |
| 3,673,821 | 7/1972 | Johnson | 66/177 |
| 3,802,229 | 4/1974 | Fregeolle | 66/177 |
| 4,000,630 | 1/1977 | Imboden | 66/177 |

FOREIGN PATENT DOCUMENTS

| | | | |
|---|---|---|---|
| 2,032,241 | 11/1970 | France | 66/177 |

OTHER PUBLICATIONS 1,807,974, 7-30-1970 German Application (Palke-Rohen) 66-177.

1,800,166 4-9-1970 German Application (Hudson) 66-177.

*Primary Examiner*—James Kee Chi

[57] ABSTRACT

The garment is adapted to fit the lower body of the wearer and includes seamless circularly knit tubular legs integrally knit with the body or panty portion. Side gusset panels are provided at opposite sides of the panty portion and are integrally knit with and connected to the legs along upwardly and outwardly inclined gore lines extending from the crotch area so that the outer upper portions of the legs are positioned at a substantial distance above the crotch area.

12 Claims, 9 Drawing Figures

LOWER BODY GARMENT AND METHOD OF MAKING SAME

This invention relates generally to seamless knit two-legged lower body garments, such as panties, panty girdles, panty hose, tights and the like. More particularly, the present invention relates to the knitting of such a garment on a circular knitting machine and having either long or short seamless circularly knit tubular legs with the panty portion including a single pair of side panels or gussets at opposite side of a group of complete courses in the central portion so that the outer upper portions of the legs are positioned at a substantial distance above the crotch area and the garment is shaped to closely conform to the contour and figure of the wearer.

Garments of this general type are disclosed in U.S. Pat. Nos. 2,962,884; 3,109,300 and 3,109,301. The garments disclosed in these patents are fashioned by what may be termed the "double gusset" knitting of reciprocatorily knit partial courses at each side of the body of the garment and the knitting of each of these double gussets or panels requires both a widening and narrowing operation while the knitting machine cylinder reciprocates. In accordance with these patents, the shape of the garment may be varied so that the garment may be formed to fit wearers of different sizes. However, the knitting of the widened and narrowed double gusset at each side of the garment requires considerable knitting time and thereby increases the cost of production of the garment. Also, the upper ends of the seamless circularly knit tubular legs of this type garment extend in a substantially horizontal line across the upper thigh area of the leg of the wearer.

In order to reduce the time required for knitting this type of garment the widened and narrowed double gussets have been completely eliminated and the entire garment knit of full complete circular courses in a straight tubular fashion. However, this type of garment, even though being knit of a highly stretchable type yarn, does not provide the proper fit to the wearer. In an attempt to improve the fit and wearing comfort of this type garment, partial courses have been interspersed with the full complete courses in portions of the body or panty portion in order to provide some curvature to the body portion of the garment. Groups of partial courses have also been formed in the central portion of the tubular blank to obtain a curved configuration. The addition of the interspersed or grouped partial courses still does not provide the required amount of additional fabric in the body portion of the garment and while the production time is less than the production time of the double gusset type garment, the production time is slightly longer than the production time of the straight tubular type garment.

In order to provide more shaping or fashioning in this type of garment, it has recently been proposed that this type of garment be formed by knitting large fashioned gussets or panels at the upper ends of the legs and knitting very small fashioned gussets or panels at opposite sides of the body portion of the garment. This type of garment does reduce the required knitting time, as compared to the time required to knit the garments disclosed in the above-listed patents. The knitting of the large fashioned gussets at the upper ends of the legs does provide additional fabric in the upper leg portions of the garment, however, the knitting of the small fashioned gussets does not provide sufficient fabric in the body portion of the garment. Also, when it is desirable to use reinforcing or heavy denier yarn in the body or panty portion of the garment, the heavy denier yarn extends down to the uppermost circular courses of the legs so that the line of demarcation between the sheer yarn used in the leg portions and the heavier denier yarn used in the panty portion extends in substantially a horizontal plane around the upper thigh area of the leg of the wearer and this feature may be objectionable by wearers of mini skirst, shorts and the like.

With the foregoing in mind, it is an object of the present invention to provide a seamless knit two-legged lower body garment having a single partial course fashioned gusset or panel at each side of the body of the garment and with the upper portions of the seamless circularly knit tubular legs extending outwardly and upwardly from the crotch area whereby the outer upper portions of the legs are adapted to engage hip portions of the wearer. This garment provides a fit and shape closely conforming to the contour and figure of the wearer and the garment may be economically knit on a circular knitting machine in a relatively short period of time.

In accordance with the present invention, the legs of the garment are formed of complete circular courses while the needle cylinder is continuously rotated and the panty portion is integrally knit with and connects the legs. The panty portion includes a group of complete courses extending through the central portion of the panty and forming a crotch area between the legs. Single fashioned side panels or gussets of reciprocatorily knit fashioned partial courses are provided in each half of the panty portion at opposite sides of the panty portion so that the legs are joined to the side panels along lines extending upwardly and outwardly from the crotch area. When the legs are knit of small stitch loops and with a sheer stretch yarn and the panty portion is knit of large stitch loops and with a heavier denier stretch yarn, the juncture line is curved and a substantial number of the knit courses of at least the medial portion of the side panels extend substantially perpendicular to and are joined to the uppermost of the knit courses of the legs. The ends of the courses of the side panels at the front and rear of the panty portion are joined along single gore or suture lines to the corresponding stitch loops of the adjacent complete courses of the legs while the side panels are integrally knit with and at opposite sides of the complete courses in the central portion of the panty.

The garment of the present invention may be economically knit on a circular knitting machine of the type normally utilized in knitting hosiery, panty hose and the like. The garment may be provided with long legs having closed lower toe end portions for providing a panty hose or tights type of garment or the garment may be formed with leg portions comprising only a few circular courses to provide a panty or panty girdle type garment.

The single fashioned gussets or side panels are formed only in the panty portion so that the upper ends of the legs extend upwardly and outwardly from the crotch area at both the front and rear. Therefore, it is possible to knit the panty portion of a panty hose type garment with a heavy denier yarn and the legs of a fine denier yarn and the heavy denier yarn in the panty portion will not be seen when the garment is worn with mini skirts, shorts and the like. Also when a panty type garment is formed in accordance with the present invention, the short leg portions will extend upwardly and outwardly from the crotch area at both the front and rear so that the garment has substantially the same shape as a conventional brief type panty.

Other objects and advantages of the invention will appear as the description proceeds, when taken in connection with the accompanying drawings, in which FIG. 1 is a front elevation of a seamless panty hose blank which is knit in accordance with the present invention and illustrating the appearance of the panty blank after it is removed from the knitting machine with the lower toe end portions of the legs being closed;

Figure 1:
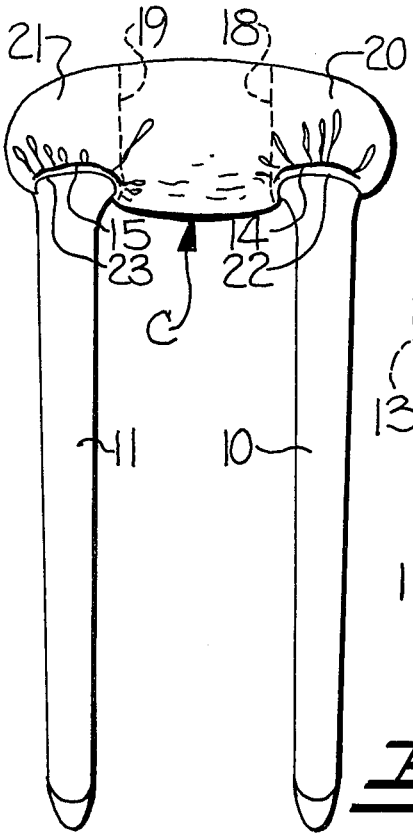
Figure 2:
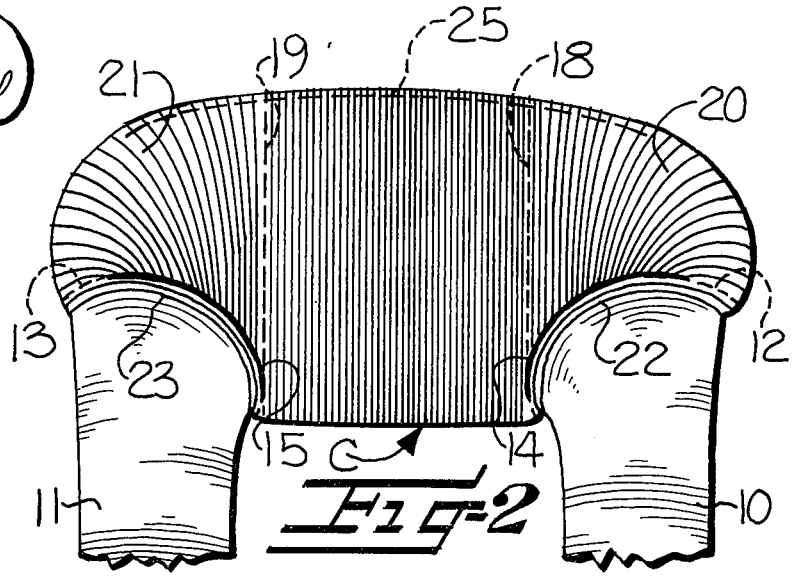
FIG. 2 is an enlarged and schematic elevational view of the upper portion of the panty hose shown in FIG. 1.

The garment blank illustrated in FIG. 1 is knit in a suitable shape for forming a panty hose type garment and includes a pair of seamless circularly knit tubular legs 10, 11, which are preferably formed entirely of successive complete courses. The courses of the legs extend substantially horizontally or transversely of the legs 10, 11. The shade lines in FIG. 2 indicate the direction in which the courses extend in various portions of the garment. As illustrated in FIG. 2, the upper ends of the legs 10, 11 terminate along the respective dotted lines 12, 13 and respective front gore lines 14, 15 and corresponding rear gore lines 16, 17 (FIG. 5).

The panty portion of the garment is integrally knit with and connects the legs 10, 11 and includes a group or panel of circularly knit complete courses extending between the dotted lines 18, 19 and through the central portion of the panty portion to form a crotch area, broadly designated at C between the legs 10, 11. The lower portions of the complete courses in the center of the panty portion are integrally knit with the corresponding portions of the adjacent complete courses of the legs 10, 11. A single group of reciprocatorily knit fashioned partial courses is formed at opposite sides of the panty portion and provides a single pair of gussets or side panels 20, 21. The gussets 20, 21 extend across the top of the garment blank and down the rear in the same manner as the front portions are illustrated in FIG. 2 to provide a single pair of front and rear body gussets at opposite sides of the complete courses in the central portion of the panty. The ends of the partial courses in the gusset 20 are joined along the respective front and rear gore lines 14, 16 to the corresponding stitch loops of the uppermost complete courses of the leg 10 while the ends of the partial courses in the gusset 21 are joined along the respective front and rear gore lines 15, 17 to the corresponding stitch loops of the uppermost course of the leg 11.

The particular fashioning of the single pair of gussets 20, 21 of the body portion of the garment will be presently described in connection with the description of the method of knitting the garment. As best illustrated in FIG. 2, the fashioned side panels or gussets 20, 21 provide pockets of additional fabric in the body portion of the garment while the legs 10, 11 do not contain any fashioned leg extensions or pockets but are knit of complete circular courses.

Figure 4:
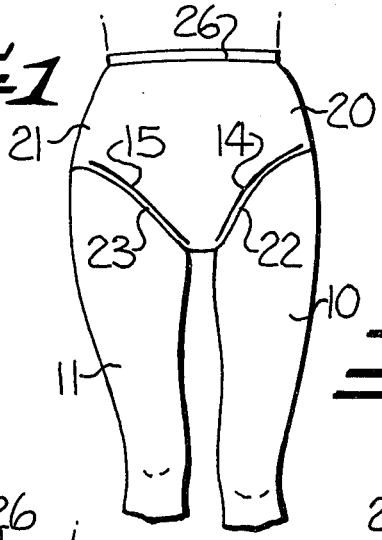
FIG. 4 is a front view of the upper portion of the panty hose garment and illustrating the same as it appears when worn.
Figure 5:
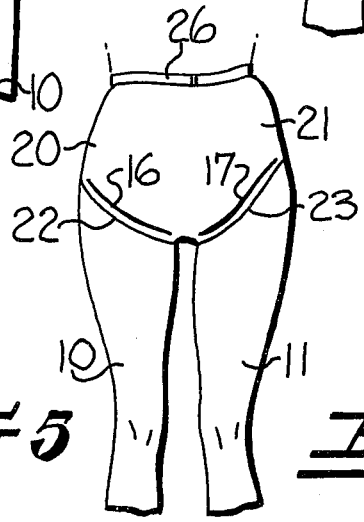
FIG. 5 is a view similar to FIG. 4 but illustrating the rear portion of the garment.
Figure 6:
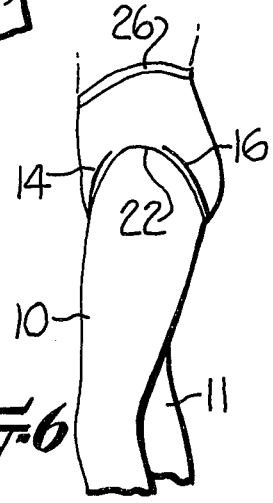
FIG. 6 is a view similar to FIGS. 4 and 5 but illustrating one side of the garment.

As will be noted in FIGS. 1 and 2, the upper ends of the legs 10, 11 terminate along the curved front gore lines 14, 15 (and corresponding rear gore lines 16, 17, not shown in these figures) which gore lines extend from adjacent the crotch area of the panty hose and generally upwardly and outwardly therefrom whereby the upper portions of the legs are positioned at a substantial distance above the crotch area of the panty, particularly when the garment is worn, as illustrated in FIGS. 4–6, and the upper outer ends of the legs are adapted to engage the upper hip portions of the wearer. When the garment is worn as illustrated in FIGS. 4–6, the upper ends of the circularly knit legs 10, 11 terminate along substantially straight inclined lines extending from adjacent the crotch area of the panty portion and generally upwardly and outwardly therefrom whereby the upper portions of the legs are positioned at a much higher level than the inner portions of the respective legs and the side panels or gussets 20, 21, each have portions positioned above the outer uppermost portions of the legs and serve to define hip engaging portions of the garment. As is best illustrated in FIG. 2, a substantial number of the knit courses of at least the medial portion of the respective side panels 20, 21 extend substantially perpendicular to the uppermost knit courses of the respective legs 10, 11. Also, the opposed ends of the knit courses of the respective side panels 20, 21 are directly connected to the uppermost knit courses of the respective legs 10, 11 and along the respective front and rear gore or suture lines 14, 15 and 16, 17.

The few uppermost complete courses of the legs 10, 11 (above the lines 22, 23) and the entire panty portion of the garment is preferably knit of a heavier denier yarn than the legs 10, 11 and the panty hose is preferably formed of a suitable type of stretchable yarn so that it may be easily drawn on the body of the wearer, as illustrated in FIGS. 4–6.

In order to provide a waist opening, the upper edge portion of the panty hose blank is slit along a dash-dot line 25. The slit along the line 25 may be formed after the knitting of the blank is completed or the slit may be formed during the knitting operation by use of a suitable cutting device, such as is illustrated in U.S. Pat. No. 3,670,528. In either case, an elastic band, indicated at 26 in FIGS. 3–6, may be suitably attached to the upper edge of the panty portion to provide a finished waist opening.

It is to be understood that the single pair of gussets 20, 21 and/or the group of centrally knit complete courses extending therebetween may be knit of the same or of different types of yarn and may be knit of a heavy elastic to provide body control and support in the panty portion. Also, an elastic yarn may be inlaid or otherwise incorporated in selected areas of the panty portion and/or legs to provide support. Also, selected areas of the panty hose may be knit with any desired type of plain or patterned stitch to provide open mesh or other patterns.

Figure 3:
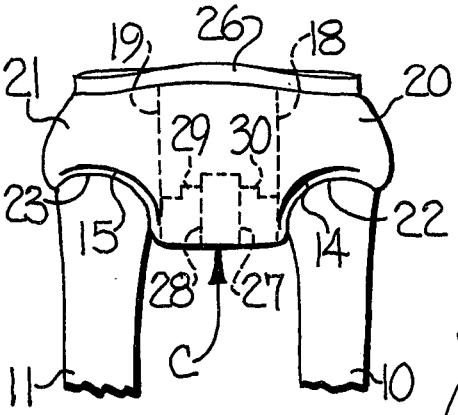
FIG. 3 is a view similar to FIG. 1 with the upper end of the blank slit and an elastic waist band being attached thereto.

If desired, the central panel of the panty portion of the garment may be provided with a suitable "crotch patch", as indicated in dotted lines in FIG. 3. The width of the crotch panels or patch may be varied as desired and may be in the form of a rectangle extending between the dotted lines 27 and 28 and extending upwardly in the front and rear of the garment to the desired height. Also, the upper ends at the front and rear of the crotch patch may be straight or stepped, as illustrated by the dotted lines 29, 30 in FIG. 3. The crotch patch may be knit by incorporating a reinforcing or additional hydrophillic yarn, such as cotton, which is knit in plated relationship with the regular yarns forming the circular courses in the center panel or the yarn may be knit in plated relationship with the body yarn and form terry loops on the inner surface of the crotch panel of the panty portion. The terry loops are formed in the well-known manner of feeding the auxiliary or additional yarn over the nibs of the sinkers or by any other well-known means.

Since the leg portions of the garment illustrated in FIGS. 1–3 are formed by a much finer denier stretchable yarn than the yarn knit in the panty portion, the fabric in the side panels 20, 21 has a tendency to pucker and wrinkle along the respective front and rear gore lines 14, 15 and 16, 17 when the garment is in the relaxed and unboarded position shown in FIGS. 1 and 3. However, these gore lines have a tendency to straighten and the gathered and puckered fabric of the side panels disappears when the garment is worn, as illustrated in FIGS. 4–6.

Figure 7:
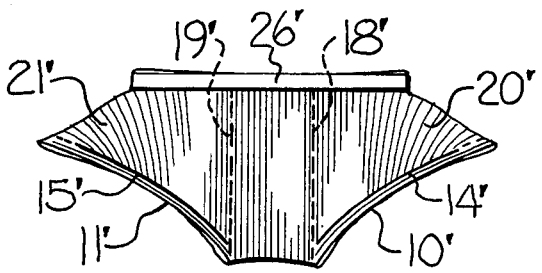
FIG. 7 is a front elevation of a seamless panty type garment which is knit in accordance with the present invention.

The panty type garment shown in FIG. 7 is identical to the panty hose type garment shown in FIGS. 1–6 except that the leg portions 10′, 11′ comprise only a few full complete circular courses extending between the front gore lines 14′, 15′ and rear gore lines 16′, 17′. The upper portion of the garment blank is slit and provided with a suitable waistband 26′ to provide a waist opening.

Figure 8:
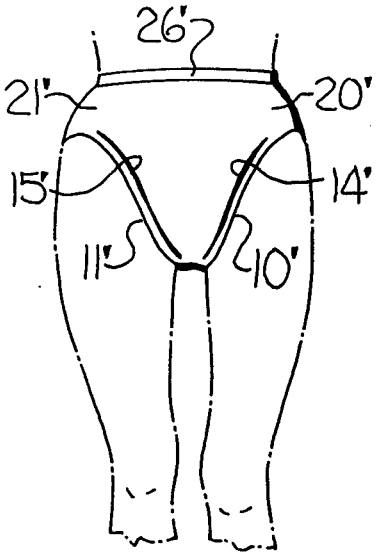
FIG. 8 is a front view of the panty garment shown in FIG. 7 and illustrating the same as it appears when worn.

However, it will be noted that the panty type garment illustrated in FIG. 7 appears to be quite different from the panty portion of the panty hose garment illustrated in FIGS. 1–3, when not being worn. This change in appearance is caused primarily by the fact that the very short leg portions 10′ and 11′ are knit of the same type yarn and of the same size stitch loops as the panty portion and since they are quite short, they do not exert any downward pulling on the side panels 20′, 21′ of the panty. As illustrated in FIG. 7, no gathers, puckers or wrinkles are formed along the front gore lines 14′, 15′ and at the juncture of the leg 10′, 11′ with the panty portion. Also, when this garment is worn, as illustrated in FIG. 8, the short leg portions 10′, 11′ extend from the crotch area and upwardly with the upper end portions terminating at a higher point along the hips of the wearer.

Figure 9:
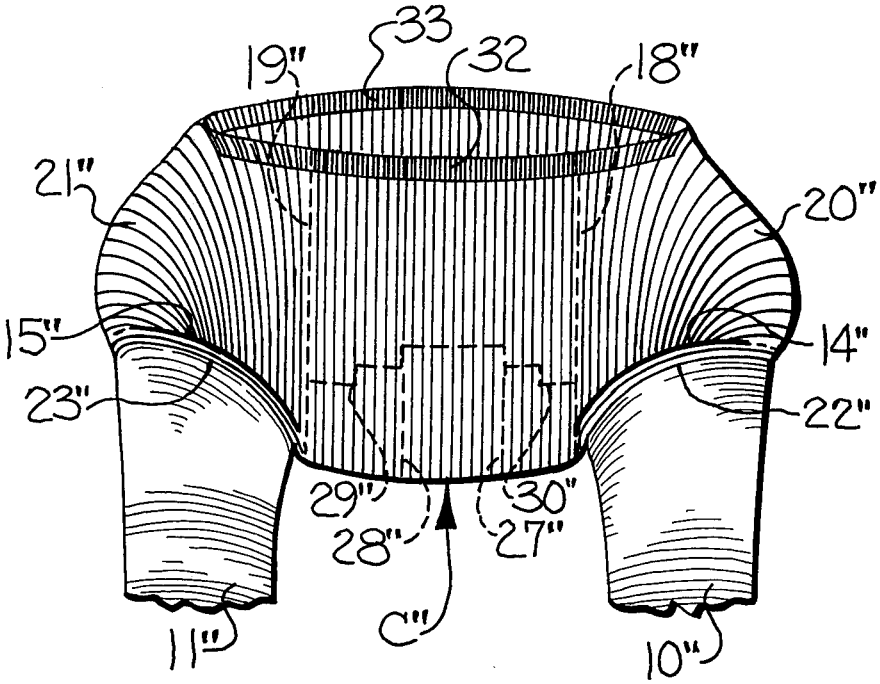
FIG. 9 is a view similar to FIG. 2 to schematically illustrate how an elastic waist opening may be formed during the knitting of the blank.

In the embodiment of the panty hose illustrated in FIG. 9, the waist opening is formed with selvedge edges along portions at the front and rear of the side panels 20″, 21″ and the center panel, and the knitting of the panty portion takes place while the needle cylinder is reciporcating in the manner described in U.S. Pat. No. 3,748,870. Additionally, a knit-in elastic waistband portions 32, 33 may be formed along the front and rear of the upper edges of the panty portion by the incorporation of elastic yarn in the few upper wales of each of the courses in this portion of the panty, as described in said U.S. Pat. No. 3,748,870. As will be noted in FIG. 9, the outermost partial courses of the side panels 20″, 21″ extend from the front gore lines 14″ and 15″ to the corresponding gore lines in the rear of the garment in a continuous manner while the innermost partial courses of the panels 20″, 21″ extend from the front gore lines 14″, 15″ upwardly to the waist opening while the corresponding partial courses in the rear extend from the waist opening down to the corresponding gore lines. The courses in the central panel, between the dotted lines 18″ and 19″, extend from the selvedge edges at the front of the waist opening through the crotch area and to the rear of the garment up to the selvedge edge of the waist opening.

A "crotch patch" or crotch panel, indicated by the dotted lines 27″, 28″ and 29″, 30″, may be formed in the center panel of the type of garment shown in FIG. 9. This crotch panel may be of the width indicated between the dotted lines 27″, 28″ or it may be wider and have stepped upper ends, as indicated by the dotted lines 29″, 30″. The crotch panel may be formed by adding extra partial courses of an additional yarn, as is described in connection with the description of the crotch panel shown in FIG. 3.

METHOD OF KNITTING

The knitting of the panty hose type garment illustrated in FIGS. 1–6 will be described as it is carried out on a fine gauge knitting machine of the type normally used in knitting ladies's hosiery. The following description of the knitting of a particular garment on a particular type of knitting machine is being presented by way of example and the present invention is not limited to this particular garment or machine.

This particular machine has a 3¾ inch needle cylinder with 400 needles in the cylinder. Knitting of the garment may begin at the lower end of either leg 10, 11 and will be described as beginning at the lower end of the leg 10. The leg 10 is knit of small size stitch loops and with 18/4 denier producer textured yarn and all 400 needles are in active position to knit full circular complete courses while the needle cylinder is continuously rotated. The size of the stitch loops being knit is gradually increased as the leg 10 is being knit to provide a gradual increase in size thereto. If desired, a heavy denier yarn may be used to make the lower toe end portion. Adjacent the upper end of the leg 10, a heavier denier yarn is introduced along the line 22 and a few full courses are knit, up to the dotted line 12 and front and rear gore or suture lines 14, 16. This heavy denier yarn is knit with a larger size stitch loop throughout the panty portion and is preferably 30 denier 2 ply stretch textured yarn.

The machine then switches into reciprocatory knitting and 300 needles which are used to knit the inner part of the leg and the crotch area of the panty hose are raised to an inactive level to pass above the stitch cams and remain in the inactive position while the needle cylinder reciprocates. Knitting of the reciprocatorily knit fashioned partial courses in the widened gusset or side panel 20 begins on the 100 remaining active needles which are used in the knitting of the outer portion of the leg to knit the partial course indicated by the dotted line 12. The narrowing and widening picks of the machine are activated so that as the needle cylinder swings in each direction, the two leading inactive needles are lowered to active level by the widening pick and single needle is raised by the narrowing pick with each swing of the cylinder so that the length of successive partial courses is increased by one needle.

During this widening operation, in the formation of the gusset or side panel 20, the endmost stitch loops of the partial courses are joined to the corresponding stitch loops of the last course at the upper end of the leg 10 and form the respective front and rear gore lines 14, 16. This widening operation is completed, to complete the formation of gusset 20, after 105 needles have been picked up at both the front and rear sides of the garment and the gore lines 14, 16 are completed. At this point, only 90 needles remain inactive in the crotch portion and they are holding the stitch loops formed during the knitting of the corresponding inner portion of the last course of the leg 10.

Upon completion of the knitting of the first gusset or side panel 20, the machine again switches to rotary knitting and the 90 inactive needles in the crotch area C are lowered to an active level and all needles knit the yarn to form the first full complete course of the center panel of the body portion of the garment, along the dotted line 18. The desired number of full circular courses are then knit on all needles between the dotted lines 18, 19. The number of full complete circular courses formed in the center panel of the panty portion is determined by the size of the garment to be knit to fit different size wearers. For example, the garments may be marketed as sizes 1, 2 and 3 and approximately 144 full courses will be knit in size 1, 156 full courses will be knit in size 2 and 180 full courses will be knit in a size 3 garment.

Upon completion of the knitting of the last complete course of the center panel of circularly knit complete courses extending through the central portion of the panty portion, along the dotted line 19, the machine again switches to reciprocatory knitting and the 90 needles which knit in the crotch area are raised to inactive level. A narrowing operation then takes place to form the second gusset or side panel 21. The first partial course of the narrowed gusset or side panel 21 is knit on the 310 active needles, along dotted line 19. During this narrowing operation, the widening pick is moved to an inactive position and the narrowing picks are operated so that they lift a single needle from the lower active position to the raised inactive position with each swing of the needle cylinder so that the length of the partial courses forming the gusset 21 is gradually reduced.

The switch loops at the ends of the successive narrowed partial courses are held on the needles raised to inactive position and held along the front and rear gore lines 15, 17. After 105 needles at the sides of the cylinder which knit along the gore lines 15, 17 are raised to inactive position, the fashioned gusset 21 is completed and all needles have been raised except the 100 active needles knitting the last partial course of the gusset 21, extending along the dotted line 13.

The machine then switches to rotary knitting and the raised inactive needles, knitting the gore lines 15, 17 and the crotch portion, are lowered to active position and the first full complete course of the leg 11 is knit on all 400 needles so that the end stitch loops of the partial courses in the fashioned gusset 21 are joined to the corresponding stitch loops formed in the first course of the leg 11 to form the front and rear gore lines 15, 17. A few full courses are then knit with the heavy denier yarn, down to the line 23. The heavy denier yarn is then removed and the fine denier yarn used to knit the leg 10 is used to knit the leg 11. Again, small size stitch loops are used to knit the leg 11 and they are gradually reduced in size as knitting of the leg progresses to provide a gradual decrease in size thereto.

The panty hose blank is then removed from the knitting machine and the lower ends of the legs 10, 11 may be closed by any suitable means to form toe pockets in the lower ends of the legs of the panty hose. It is to be understood that the lower ends of the legs 10, 11 may be closed on the knitting machine, in a well-known manner, if desired. This type of closure may be of the "twisted toe" type or by other well-known means. If the waist opening is not formed during the knitting process, in the manner heretofore described, the panty blank is slit in a wale wise direction and from one side to another along approximately the dash-dot line 25 (FIG. 2) and the elastic waistband 26 is then attached thereto, as by a sewing operation, to complete the formation of the panty hose. The panty hose may then be finished in any suitable and well-known manner, as by dyeing. However, it is preferred that the panty hose not be boarded.

Substantially the same method is employed in knitting the panty type garment illustrated in FIG. 7, except that it is not necessary to form the elongated legs 10, 11 but to merely knit a few circular courses forming the short leg portions 10', 11' at the beginning and end of the knitting of the garment. If desired, elastic bands, not shown, may be attached to the short leg portions 10', 11'.

The garment of the present invention thus includes only a single pair of gussets or side panels formed of reciprocatorily knit partial courses in the body portion of the garment. The present garment contains no fashioned gussets or extensions in the leg portions so that the extra or additional fabric provided by the fashioned gussets or side panels 20, 21 is positioned where this additional fabric is needed and the elimination of the knitting of the gussets in the leg portions reduces the required amount of time for knitting by approximately one-half the time required in knitting the garments of the type shown in the aforesaid U.S. Pat. Nos. 2,962,884; 3,109,300 and 3,109,301. Also, since the leg portions do not contain any fashioned gussets or extensions, the upper end portions of the legs extend upwardly and outwardly from the crotch area, as illustrated in FIGS. 4–6, so that the panty portion assumes the general configuration of a brief type panty. When the leg portions 10, 11 are knit of a fine denier yarn, and the panty portion is knit of a heavier denier yarn, there is no danger that the heavy denier panty portion will be seen when the wearer of this garment is wearing a mini skirt or shorts.

It is to be understood that the brief type panty shown in FIG. 7 could be worn with the panty hose garment shown in FIGS. 1–6. When the brief type panty is worn beneath the panty hose garment, its configuration will correspond with the configuration of the panty portion of the panty hose garment. If desired, the panty portion of the panty hose may be knit of the same type of sheer yarn as the legs and the brief type panty may be knit of a heavy yarn of the same or contrasting color.

The slit, shown in dash-dot lines at 25 in FIG. 2, may be formed along the upper edge of the blank or it may be formed toward the front of the blank so as to provide a little more fabric in the rear portion of the garment. Also, the length of the slit may be varied to provide a larger or smaller waist opening in the garment. However, the slit should extend down about one-half the distance of the side panels 20, 21 and should not extend down on opposite sides of the garment as far as the ends of the front and rear gore lines because the additional fabric provided by the side panels 20, 21 will not then be available for providing fullness in the upper part of the garment.

In the drawings and specification, there has been set forth a preferred embodiment of the invention, and although specific terms are employed, they are used in a generic and descriptive sense only and not for purposes of limitation.

That which is claimed is:

1. A seamless knit lower body garment comprising a pair of seamless tubular leg portions and a panty portion connecting the two leg portions and having a waist opening extending across the upper edge thereof, said panty portion including a central body portion knit of full courses extending from the waist opening in the front of said garment to the waist opening in the rear of said garment and between said leg portions to provide a crotch area, and a single reciprocatorily knit fashioned body gusset on each side of said central body portion, one of said fashioned body gussets being integrally knit with one side of said central body portion and being formed solely of narrowed partial courses, the other of said fashioned body gussets being integrally knit with the other side of said central body portion and being formed solely of widened partial courses, and the partial courses of each of said body gussets having opposed ends joined directly to the adjacent complete courses of said leg portions along corresponding gore lines.

2. A garment according to claim 1 wherein said panty portion includes an integrally knit elastic band defining the waist opening and wherein said full courses of said central body portion include elastic yarns incorporated in upper portions thereof to form portions of said integrally knit elastic band.

3. A garment according to claim 1 wherein a separate elastic band is attached to said panty portion and defines the waist opening and wherein opposed ends of the full courses of said central body portion are attached to said elastic band.

4. A garment according to claim 1 wherein said pair of seamless tubular leg portions comprise only a few courses so that the lower body garments forms a brief type panty.

5. A garment according to claim 1 wherein said pair of seamless tubular leg portions are of a length considerably greater than the length of said panty portion, and wherein the lower ends of said legs are closed so that the garment extends throughout the lower body portion of a wearer.

6. A garment according to claim 5 wherein said legs are knit of a finer denier yarn than said panty portion to provide sheerer legs for enhanced appearance.

7. A method of making a seamless knit lower body garment comprising the successive steps of knitting a plurality of complete courses to form a first seamless tubular leg portion, reciprocatorily knitting a plurality of partial courses to form a first body gusset while fashioning to increase the width of the body gusset, knitting a plurality of full courses to form a central body portion integrally knit with the first body gusset and defining a crotch area, reciprocatorily knitting a plurality of partial courses to form a second body gusset while fashioning to reduce the width of the second body gusset, and knitting a plurality of complete courses to form a second tubular leg portion integral with the second body gusset.

8. A method according to claim 7 including the knitting of elastic yarn in the upper portions of the full courses forming the central body portion to provide an integrally knit waistband portion.

9. A method according to claim 7 including the step of slitting the full courses forming the central body portion and attaching an elastic band to the slit edges to provide a waist opening.

10. A method according to claim 7 including the step of knitting only a few courses in each of said seamless tubular leg portions so that the lower body garment forms a brief type panty.

11. A method according to claim 7 including the step of knitting the seamless tubular leg portions of a considerably greater length than the central body portion so that the legs cover the legs and feet of the wearer.

12. A method according to claim 11 including the step of knitting the legs of a finer denier yarn than the body portion to provide sheerer legs for enhanced appearance.

* * * * *